US005398922A

United States Patent [19]

Malatesta

[11] Patent Number: 5,398,922

[45] Date of Patent: Mar. 21, 1995

[54] FEEDER SYSTEM FOR A MAIL SORTER

[75] Inventor: James Malatesta, Hockessin, Del.

[73] Assignee: Tritek Technologies, Inc., Newark, Del.

[21] Appl. No.: 144,222

[22] Filed: Oct. 27, 1993

Related U.S. Application Data

[63] Continuation-in-part of Ser. No. 687,671, Apr. 19, 1991, Pat. No. 5,226,547, and a continuation of Ser. No. 775,458, Oct. 15, 1991, abandoned.

[51] Int. Cl.[6] ..... B65H 5/08

[52] U.S. Cl. ..... 271/11; 271/34; 271/94; 271/104; 271/105; 271/150; 271/152

[58] Field of Search ..... 271/11, 34, 90, 94, 271/104, 105, 121, 124, 150, 152, 35

[56] References Cited

U.S. PATENT DOCUMENTS

| | | | |
|---|---|---|---|
| 2,952,457 | 9/1960 | Fliegner | 271/94 X |
| 3,430,950 | 3/1969 | Marsh et al. | 271/305 X |
| 3,550,493 | 12/1970 | Lee et al. | 271/303 X |
| 3,750,880 | 8/1973 | Petrovsky et al. | 271/305 X |
| 4,121,403 | 10/1978 | Bogdanski et al. | 53/202 |
| 4,370,048 | 1/1983 | Shibuya et al. | 271/311 X |
| 4,473,157 | 9/1984 | Hirose et al. | 271/305 X |
| 4,509,735 | 4/1985 | Kosner | 271/150 X |
| 4,674,737 | 6/1987 | Murayoshi | 271/124 |
| 4,867,432 | 9/1989 | Matta | 271/114 |
| 4,884,797 | 12/1989 | Sryatsky | 271/150 X |

FOREIGN PATENT DOCUMENTS

| | | | |
|---|---|---|---|
| 2440787 | 6/1980 | France . | |
| 2523935 | 9/1983 | France | 209/900 |
| 1217405 | 4/1964 | Germany | 271/94 |
| 1275548 | 8/1968 | Germany | 271/34 |
| 1286966 | 1/1969 | Germany | 271/305 |
| 2132400 | 9/1973 | Germany . | |
| 0287644 | 12/1986 | Japan | 271/94 |
| 0071037 | 3/1988 | Japan | 271/94 |
| 0231329 | 9/1990 | Japan | 271/11 |

*Primary Examiner*—H. Grant Skaggs
*Assistant Examiner*—Carol L. Druzbick
*Attorney, Agent, or Firm*—Connolly & Hutz

[57] ABSTRACT

A feeder system for a mail sorter includes a feed conveyor which receives a plurality of items of mail. A singulation station removes the items in a singulated manner from the discharge end of the feed conveyor and transfers each item to a delivery station. The delivery station includes a plurality of vertically mounted belts which are movable in the transverse direction for delivering the items to the mail sorter.

22 Claims, 4 Drawing Sheets

10
12
14
16
18
20
22
140
142
144
146
148
150
152
152A
152B
154
156
158
160
162
164
166
168
170
174
176
178
180
182
184

10
12
14
16
18
20
22
114
142
158
164
168
186

FEEDER SYSTEM FOR A MAIL SORTER

This application is a continuation-in-part of application Ser. No. 07/687,671, filed Apr. 19, 1991, now U.S. Pat. No. 5,226,547, and a continuation of application Ser. No. 07/775,458, filed Oct. 15, 1991, now abandoned.

BACKGROUND OF INVENTION

Parent application Ser. No. 07/687,671, now U.S. Pat. No. 5,226,547 relates to a mail transport assembly for a mail sorting system. The assembly of the parent application is concerned with delivering various individual items of mail to selected bins in accordance with a mail sorting arrangement consisting of a predetermined bin for each item of mail. With such a system, it is necessary to feed the individual items of oriented mail to the sorter. Where such a system is intended to be used with automated mail sorters handling a large number of items, difficulties arise when the individual items of mail differ from each other. It would be desirable, for example, if a feeder could be provided which is capable of handling various types of items of mail including unbound magazines, folded newspapers, plastic-covered items, Tyvek envelopes and the like. Such a feeder system would have particular utility with automated mail sorters such as TRITEK TM 88-5 and the 91-5 ULTRASORTER. The 88-5 system uses an optical character reader to presort mail in private industries and mail houses. The 88-5 system includes a support surface on which the mail is conveyed with a reader arrangement determining which of the plurality of downstream bins would receive the individual items of mail in the individual categories as defined, for example, by different zip codes.

SUMMARY OF INVENTION

An object of this invention is to provide a mail feeder system which is particularly adapted for use with a high speed mail sorting system.

A further object of this invention is to provide such a mail feeder system capable of handling diverse types of oriented mail including unbound magazines, catalogs, open window envelopes, folded newspapers, Tyvek envelopes and the like.

In accordance with this invention the feeder system for the mail sorter includes a feed conveyor which receives a plurality of items of mail. A singulation station is located for removing the individual items of mail from the discharge end of the feed conveyor and transferring each item seriatim to a delivery station. The delivery station includes a plurality of vertically mounted belts for delivering the items seriatim to the sorter.

In a preferred practice of this invention, the feed conveyor is a flat endless belt having a horizontal upper run on which the items are conveyed. The items are stacked on the feed conveyor side by side in a vertical disposition with the edges on the item on the upper run. A paddle is disposed against the last item to maintain the stack vertically. A portion of the paddle contacts the upper run so that the paddle maintains its contact with the vertical stack of items as the conveyor is moved in a downstream direction.

In a preferred practice of the invention, the singulation station includes a first vacuum chamber having continuously exposed slits in its face disposed toward the feed conveyor to apply a suction action against the side of the item of mail as the item is moved into contact with the vacuum chamber to initially hold the item of mail. A vertically mounted belt moves around a second vacuum chamber provided with holes. The vertically mounted belt, in turn, is provided with holes for selective registry with the holes in the second vacuum chamber so that the vertically mounted belt alternatively covers and exposes the second vacuum chamber holes and thereby provides a sufficient force for removing each item of mail away from the first vacuum chamber and transferring it toward the delivery station.

THE DRAWINGS

DETAILED DESCRIPTION

Figure 2:
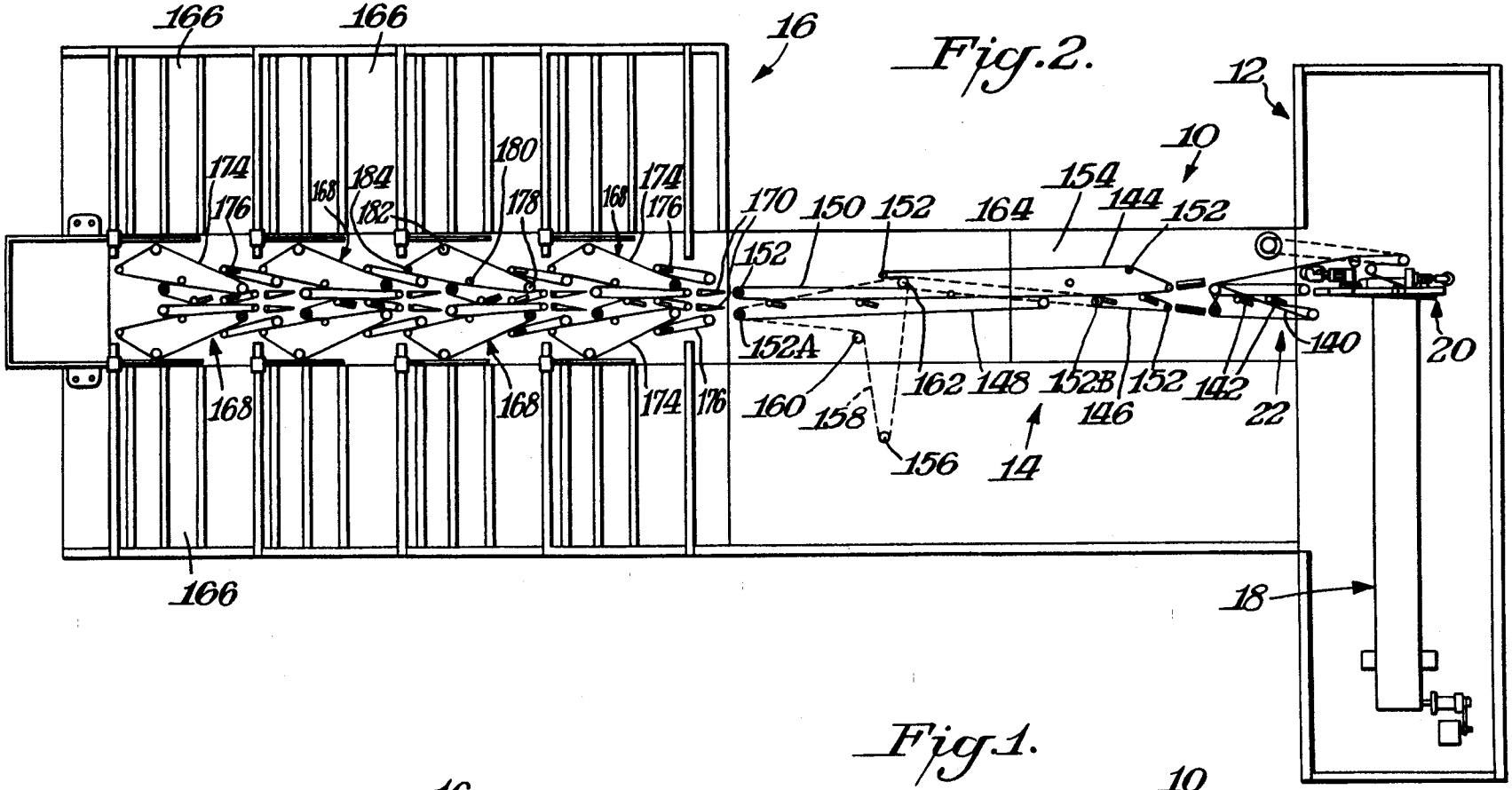
FIG. 2 is a top plan view of the mail sorter shown in FIG. 1.
Figure 1:
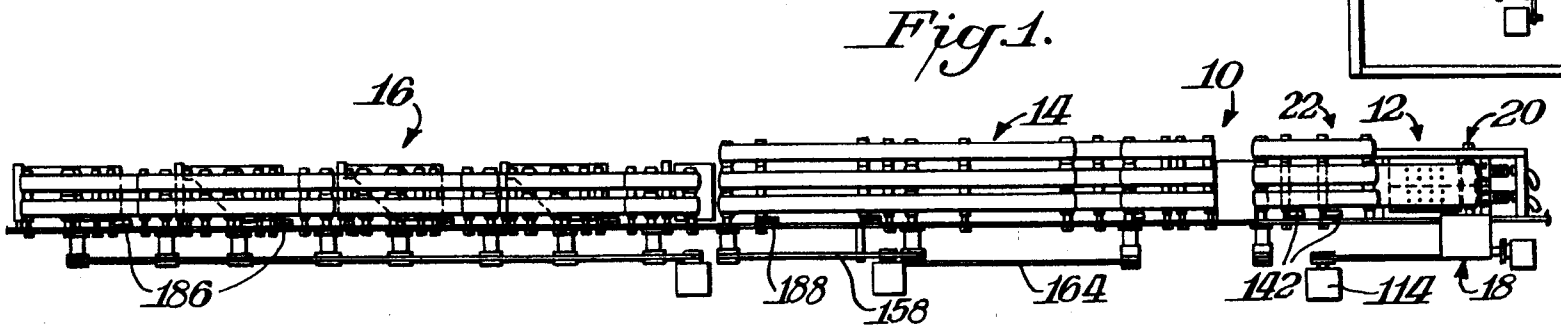
FIG. 1 is a side elevational view of a mail sorter which utilizes the feeder system of this invention.

The present invention is directed primarily to a feeder system to a mail sorter which processes individual items of mail automatically at a high rate of speed. Such a sorter is preferably the TRITEK TM 88-5 Sorter System or the 91-5 ULTRASORTER which is capable of sorting over 30,000 pieces of mail per hour. The present invention also relates to variations of the transport portion of the sorter. FIGS. 1–2, for example, illustrate a sorter 10 in which the invention may be used. As shown therein the sorter 10 includes a feeder system 12 which feeds individual items of mail to the sorter section 14 which in turn delivers the individual items to the transport stacker section 16. Transport stacker section 16 is preferably of the type shown and described in parent application Ser. No. 07/687,671 filed Apr. 19, 1991, the details of which are incorporated herein by reference thereto. The present invention, however, is also concerned with certain modifications to that transport system as will later be described.

In general, the feeder system 12 includes a feed conveyor section 18, a singulation station 20, and a delivery station 22.

Figure 3:
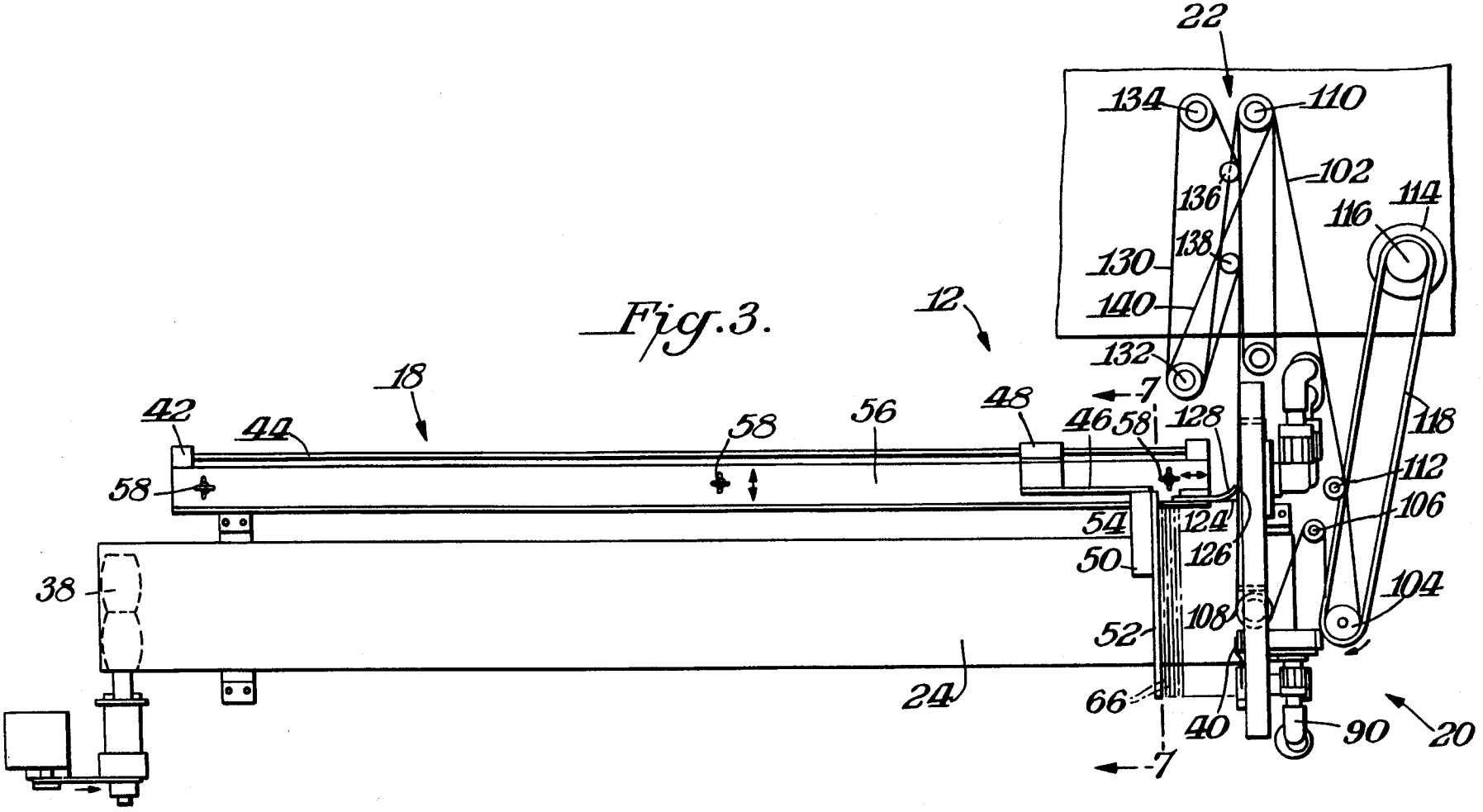
FIG. 3 is a top plan view showing the feeder system of FIGS. 1–2.
Figure 4:
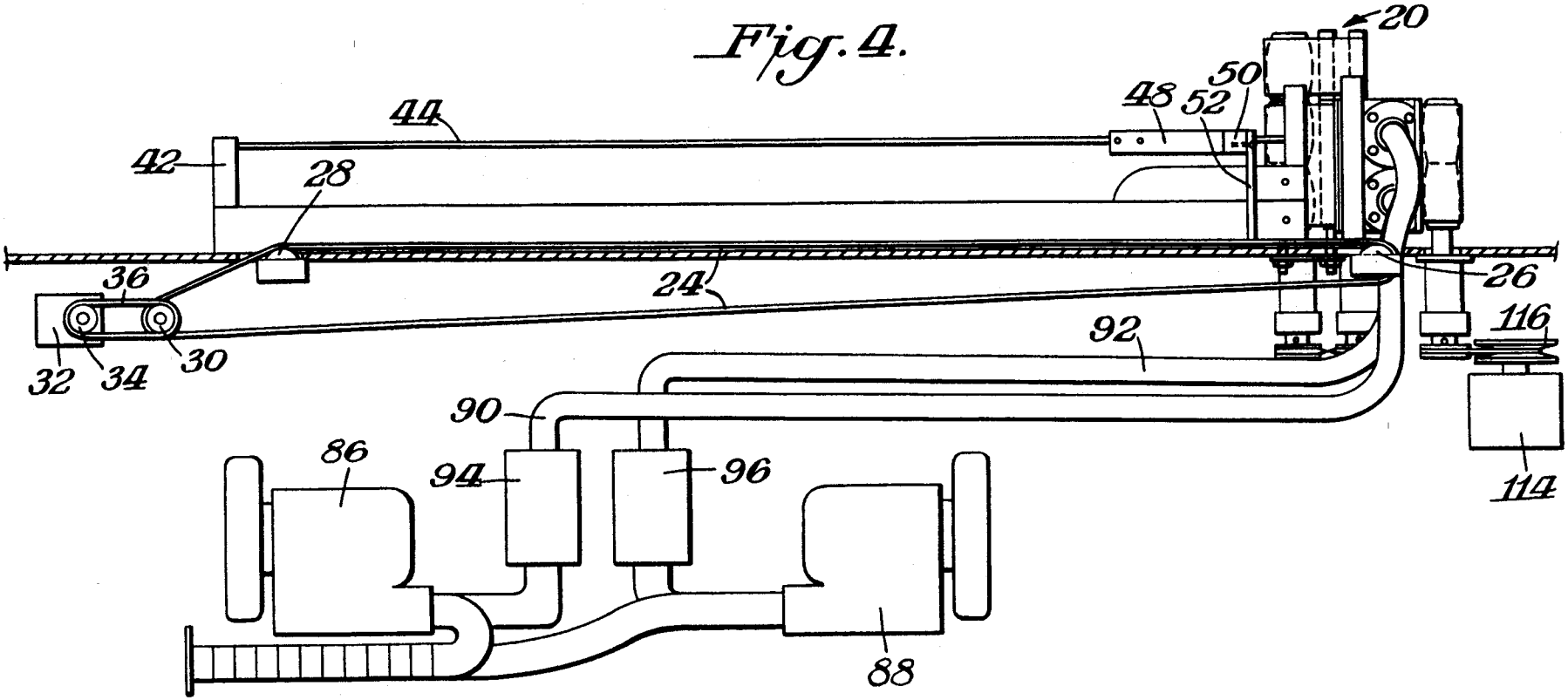
FIG. 4 is a cross-sectional view of the feed conveyor and transfer station portions of the feeder system shown in FIGS. 1–3.
Figure 7:
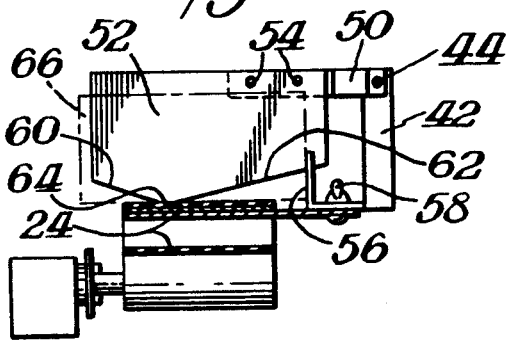
FIG. 7 is a cross-sectional view taken through FIG. 3 along the line 7—7.

FIGS. 3–4 and 7 best illustrate the details of the feed conveyor section 18. As shown therein, the feed conveyor section 18 includes a flat endless belt 24 which is mounted over a plurality of rollers 26,28,30 as best shown in FIG. 4. Belt 24 includes an upper horizontal run as also shown in FIG. 4. Belt 24 is driven in any suitable manner such as by torque motor 32 which rotates pulley 34 to drive belt 36 mounted over pulleys 30 and 34. Accordingly, torque motor 32 thereby rotates pulley 30 which in turn causes belt 24 to rotate. As best shown in FIG. 3 belt 24 itself is mounted on lateral extension 38 (shown in phantom) which extends from pulley 30. The actuation of torque motor 32 is controlled a microswitch 40 located at the discharge end of belt 24. In this respect, when pressure is applied to microswitch 40 as for example from contact by an item of mail, torque motor 32 is inactivated and belt 24 momentarily stops. Once the item of mail is removed from contact with microswitch 40 the microswitch 40 returns to its normal position wherein torque motor 32 is again activated and belt 24 is moved another increment until the next item of mail contacts microswitch 40. Because feeder system 12 operates at such high speed, however, the incremental movement of belt 24 is not readily discernable with the naked eye.

As best shown in FIGS. 3–4 a vertical guide 42 is mounted along side of and parallel to conveyor 24. Guide 42 includes at its upper end a guide rail 44 around which an arm 46 travels by means of a linear bearing embedded within extension 48. Arm 46 includes a pair of offset extensions 48,50. Paddle 52 is secured by fasteners 54 to extension 50. The offset arrangement is advantageous since it disposes the paddle 52 downstream from the linear bearing mount of extension 48 so that the paddle 52 may move the full distance downstream and contact singulation station 20 without its mounting extension 48 causing any interference.

The base 56 of mounting guide 42 is provided with suitable fasteners 58,58,58 in slots at spaced locations to permit the base 56 to move toward and away from singulation station 20 at flap 126 to provide tension adjustment which may be determined by the specific thickness of the items of mail being handled. The back and forth adjustments are indicated by the arrow in FIG. 3 at flap 126. The arm 46 having its parallel offsets 48,50 is also best shown in FIG. 3.

FIG. 7 best illustrates the details of paddle 52. As shown therein, paddle 52 has a pair of inclined lower edges 60,62 which form a lower most corner or projection 64. Projection 64 is disposed on the upper run of belt 24. Accordingly, as belt 24 moves the contact of corner or projection 64 causes paddle 52 to move with belt 24. Paddle 52 is preferably adjustably mounted to offset extension 50 so as to permit its location to best conform to the items of mail being handled. Because of the tapered construction at the lower end of paddle 52, it is more difficult for the mail to cause paddle 52 to break contact with belt 24. Paddle 52 may also be connected to a counter weight in the downstream direction to assure maintaining contact with the individual items of mail.

In operation, as shown in FIG. 3, a plurality of individual items of mail 66 would be placed on the horizontal run of flat conveyor 24 with the items of mail disposed in a side by side relationship on their edges. All items of mail 66 which are unbound must be oriented with their bindings in contact with belt 24. The items of mail 66 would be maintained in this vertical side by side relationship stack by initially sliding paddle 52 against the last item of mail so that the stack is sandwiched between paddle 52 and singulation station 20. As each item of mail is removed from singulation station 20 by the rapid intermittent motion of conveyor 24, paddle 52 remains in contact with the last item of mail because of corner 64 of paddle 52 being disposed against conveyor 24. Ultimately, when the last item of mail is discharged paddle 52 itself contacts microswitch 40 to inactivate motor 32 and thereby halt the movement of conveyor 24.

Singulation station 20 is best shown in FIGS. 2–6. As shown therein singulation station 20 includes an initial hold means 68 and a transfer means 70. Initial hold means 68 is generally in the form of a first vacuum chamber 71 which is divided into two compartments 72,74. Each compartment contains a number of openings 76. The openings 76 may take any suitable form and are preferably slit-like openings with four such openings being provided for each vacuum chamber compartment. As is readily apparent from FIG. 5 holes or openings 76 remain constantly exposed toward the discharge end of flat belt 24. Accordingly, as an item of mail 66 is moved into contact with the exposed wall of chamber 71, the suction slits 76 initially hold the item of mail in its vertical position against the wall of chamber 71. When held in this position, the flat item of mail also contacts microswitch 40. Vacuum chamber 71 extends partially across the discharge end of belt 24.

A second vacuum chamber 77 is juxtaposed first chamber 71 and extends the remaining distance across belt 24 and a portion therebeyond. Second vacuum chamber 77 also is in the form of two compartments 78,80. Each compartment 78,80 is provided with a number of enlarged holes 82 which may be in any suitable shape and number. In the preferred practice of the invention, the holes 82 are circular with four holes being provided for each vacuum chamber compartment. Downstream from holes 82 are smaller holes 84 which may also be of any suitable number and shape and preferably are also circular in shape with four such holes being provided in each compartment. As indicated the holes 84 are of smaller size than the main or gripping holes 82 and function to supplement the mail transportation after pickoff from chamber 71.

The sets of vacuum chamber compartments are provided with their own vacuum lines. For example, as illustrated in FIG. 4 a pair of vacuum pumps 86,88 are provided each with its own vacuum line 90,92. An air box with filter 94 is provided in line 90 while air box with filter 96 is provided in line 92. Line 90 communicates with the two top compartments 72,78 while line 92 communicates the bottom compartments 74,80. The return line 98 leads from the top compartments back to pump 86 while a return line 100 leads from the bottom compartments back to pump 88.

Although the drawings herein illustrate a separate vacuum pump and line for each of the two upper and each of the two lower vacuum chamber compartments, it is to be understood that the invention may also be practiced with a single pump for all four compartments or with each compartment having its own vacuum pump or with each chamber having its own vacuum pump. Each chamber may also include any number (including one) of compartments.

By orienting the items of mail such as fastened or unfastened multi-page items with the binding edge downward in a horizontal position an effective transporting of the items is assured. For example, if the binding were vertical, there would be a tendency for the items to open while some pages are transferred downstream with other pages tending to remain held against the vacuum chambers. When the binding is downward in a horizontal orientation all pages remain together during transportation.

Figure 5:
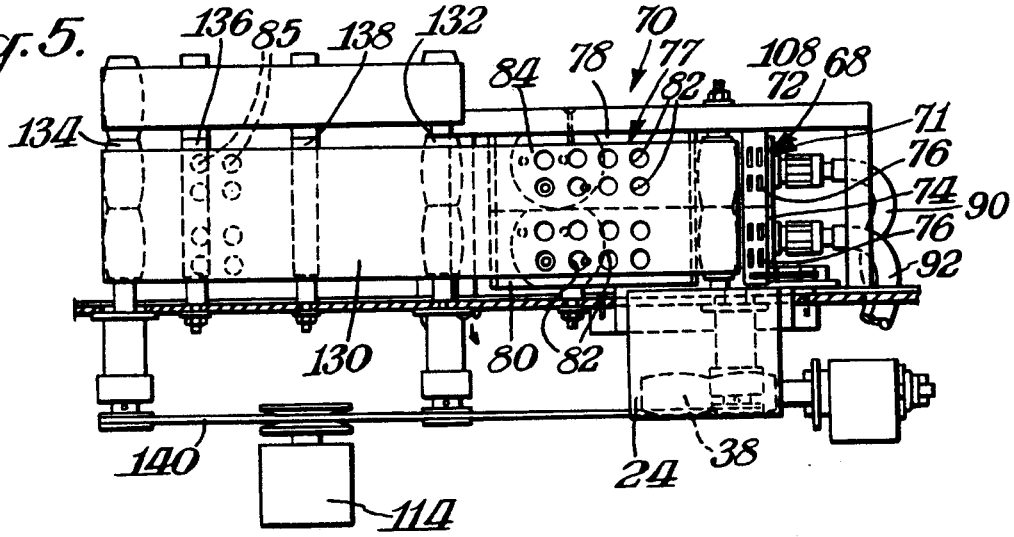
FIG. 5 is a front elevational view partly in section of the transfer station shown in FIGS. 1–4.
Figure 6:
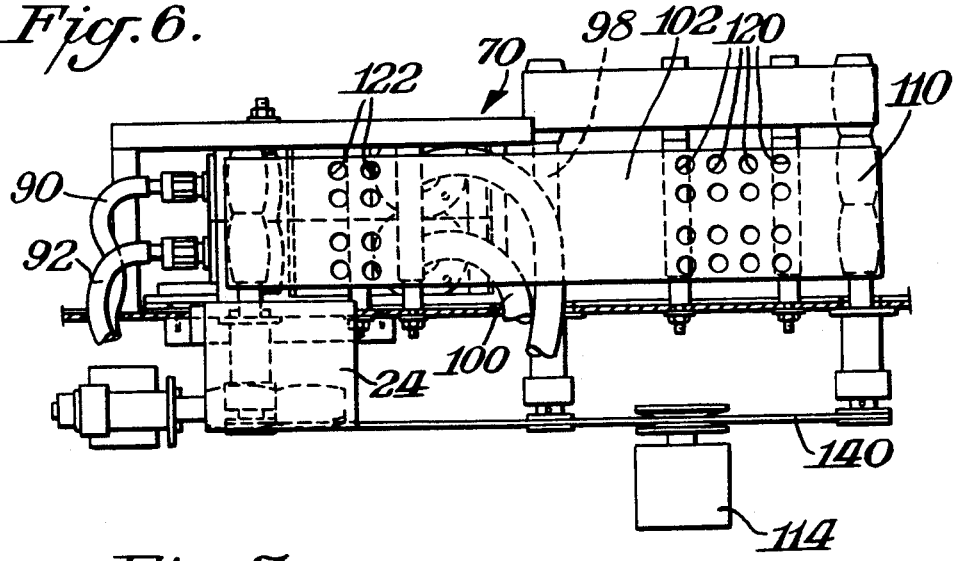
FIG. 6 is a rear elevational view partly in section of the transfer station shown in FIG. 5.

As best shown in FIGS. 3 and 5–6 the transfer means includes a vertically mounted belt 102 disposed against the front face of second vacuum chamber 71. Belt 102 is driven by being mounted around drive roller 104 and additional rollers 106,108,110 and 112. Drive roller 104 in turn is driven by means of drive motor 114 which drives its pulley 116 to drive belt 118 also trained around the bottom pulley of drive roller 104.

As best shown in FIGS. 5–6 belt 102 includes a set of, for example, sixteen holes 120 and a second set of eight holes 122 spaced from holes 120. The number and location of these sets of holes is selected to correspond to the holes 82 and 84 in the front face of vacuum chamber 71. Accordingly, holes 120 and 122 cyclically align with the large gripping holes 82 and the smaller relief holes 84 as belt 102 is moved around its roller system. As a result, when the holes in belt 102 are aligned with the gripping holes 104 the vacuum applied from chamber compartment 78,80 is sufficient to draw the item of mail against belt 102 and to transport the item of mail away from flat belt 24 by overcoming the coefficient of friction between the item of mail and the next item of mail in stack 66. In order to assure sufficient contact with the item of mail and vertical belt 102 while the item of mail is still on horizontal flat belt 24, roller 108 is located at least midway across the transverse direction to create an angle on belt 102, as shown in FIG. 3. Preferably, belt 102 is made of a material which is relatively rough to provide some frictional contact with the item of mail thereby minimizing any tendency of the belt to slip past the item of mail whereby the item of mail would thus remain on flat belt 24 and in contact with stack 66. The movement of transport belt 102 causes each item of mail 66 to be transported away from belt 24 singulated from stack 66 and transported into delivery station 22. As best shown in FIG. 3 a series of flaps are provided at the entrance of entry station 22. These flaps in the preferred practice of the invention comprise an inner flap 124, intermediate flap 126 and an outer flap 128. Inner flap 124 is mounted generally perpendicular to belt 102 and is disposed for making edge contact or may be spaced very slightly from belt 124 so that the item of mail 66 may readily be conveyed between flap 124 and belt 102. Flap 126, however, is disposed for making some surface contact with belt 102 so as to apply a greater contact area against item of mail 66 that may be two pieces of mail thus holding back the upstream piece not in contact with belt 102 while belt 102 continues to transport a single piece. Outer flap 128 is disposed for making greater surface contact than flap 126. Thus, the item of mail is gradually subjected to increasing surface contact on its side opposite belt 102 to assure maintaining the item of mail 66 in contact with belt 102 as the item 66 is being transported through the system while holding back the next piece of mail. In the preferred practice of this invention the flaps are adjustably mounted in any suitable manner so that their distance toward and away from belt 102 could be varied in accordance with the thickness of items of mail or with wear characteristics of the flaps. Preferably the three flaps 124,126 and 128 are jointly mounted for the sake of simplicity. If desired, however, the flaps may be individually mounted for adjustability.

Downstream from the flaps is a pinch or delivery belt 130 which is also vertically mounted about rollers 132,134,136,138. The drive for belt 130 is achieved by a criss-cross of round belt arrangement resulting from belt 140 being mounted in figure eight fashion around rollers 132 and 134. Thus the same drive utilized for belt 102 also drives delivery belt 130. As can be seen from FIG. 3 belts 102 and 130 are disposed for contacting each other in the area between rollers 136 and 138. Accordingly, an item of mail 66 would be initially held by the application of a suction force through slits 76 in vacuum chamber 71. When the holes in belt 102 become registered with the holding or gripping holes 82 in vacuum chamber 77 the item of mail is moved away from vacuum chamber 71 and into delivery station 22. Contact of the item of mail with transport belt 102 is assured by flaps 124, 126, 128. As the item of mail continues to be transported it then reaches the nip formed upstream from roller 138 and is passed between the otherwise contacting segments of belts 102 and 130 between rollers 136 and 138.

One of the features of this invention is that rollers 108 and 110 and vacuum chambers 71 and 78 are arranged at a slight angle off perpendicular to the longitudinal center line of flat belt 24 as best seen in FIG. 3. As a result of this arrangement, when the item of mail 66 is initially held by vacuum chamber 72,74 it is angeled parallel to the face of vacuum chamber 78,80 by the forward pull of belt 24 and vacuum from chamber 78,80. Then mail piece 66 is contacted by belt 102. As a result a complete surface contact of the item of mail 66 is angeled towards delivery station 22 thereby facilitating the removal of the item of mail 66 away from vacuum chamber 72,74.

A further feature of the invention is the provision of various guide surfaces along the transport path of the item of mail to assure that each item of mail 66 is properly conveyed through the system. For example, the various rollers located along the path of travel of the item of mail 66 may have vertical surfaces which are disposed for contacting the item of mail to maintain the item of mail in its intended vertical orientation as it moves through the system. Such guide systems could, for example, be provided at rollers 108, 110, 136 and 138. FIG. 1, for example, illustrates the guide surfaces 142 secured to the lower portion of rollers 136 and 138.

The item of mail is then conveyed from delivery section 22 into the sorter station 14. While in the sorter station 14 the item of mail may be conveyed in any suitable manner such as by means of belts 144,146,148 and 150 mounted around rollers 152 as shown in FIG. 2. FIG. 2 also illustrates in phantom the drive system for the belts in sorting sorter station 14. In this respect, the drive belts 144, 146, 148 and 150 would be mounted above a horizontal support surface 154. Certain of the rollers 152 would extend through the horizontal support surface to be driven by a drive mechanism below the horizontal support surface 154. As shown in FIG. 2, for example, a motor pulley 156 drives belt 158 which is disposed around tensioner 160 as well as around the roller 152A for conveying belt 148 and around roller 162. A round belt 164 shown in phantom would be driven around roller 162 and around roller 152B. As shown in FIG. 2 belt 146 is also mounted around roller 152B. By this arrangement it is possible to drive all of the belts in a simplified manner.

Although not illustrated sorter station 14 would include the sorting mechanisms which are described in parent application Ser. No. 07/687,671 and which are of the type that may be incorporated in the TRITEK TM 88-5 sorter.

The items of mail pass from sorter station 14 into transport station 16 where the individual items of mail are deposited in respective bins 166 in the manner described in the parent application. Accordingly, it is not necessary to repeat the detailed description of operation of the transport station 16. For purposes of this application it is noted that the transport station 16 includes a plurality of drive units 168. Each drive unit includes a pair of diverters 170 which are controlled by sorter station 14 to determine the direction of flow of each item of mail so as to thereby control the bin 166 into which the item of mail 66 will be received. Each drive unit also includes an inner belt 172 an intermediate or acceleration belt 174 and a side belt 176. As is apparent from FIG. 2 and as is described in particularity in the parent application the construction and arrangement of the two inner belts in the drive unit is opposite in juxtaposed drive units.

It is to be understood that the feeder system of this invention may be used in conjunction with the transport system of the parent application. FIGS. 1–2, however, illustrate some modifications of that transport system. For example, the intermediate belts in the parent application were mounted around a set of three rollers with the outer most roller extending downstream beyond the other two rollers. Each intermediate belt 174 of the arrangement illustrated in FIG. 1, however, is mounted around a set of four rollers 178, 180, 182 and 184. The present invention is capable of handling very large items of mail. The height of the rollers and belts in the transport system would be increased such as double or triple the height in the parent application. The rollers in sorter section 14 and the rollers shown in FIG. 3 in delivery station 22 are preferably of triple height and include three convex sections so that three belts or a single widened belt could be used without tending to slide off. Further, in order to assure maintaining the items of mail along their desired path the various rollers which are disposed along the path of travel would also be provided with vertical guide surfaces at the base of each such roller. Such guide surfaces are indicated by the reference numeral 186 in FIG. 1 and would be similar to the guide surfaces 142 provided with the feeder system. Along the same lines guide surfaces 188 could be provided in the sorter station 14 of the sorter 10. A further difference in the arrangement of FIGS. 1–2 as compared with the parent application is that the outer most roller 182 for the intermediate or acceleration belt 174 is disposed upstream from roller 184 whereas with the arrangement of the parent application the outermost roller was also the downstream most roller. A further modification is that the intermediate or acceleration belt 174 would be driven by a round belt coupled to its drive roller to provide an extra drive rather than relying on the drive imparted from contact with the other belts of each drive unit.

It is to be understood that the present invention may be practiced with various modifications without departing from the spirit of the invention. For example, in the preferred embodiment of the invention each upper and lower vacuum compartment 72 and 74 for chamber 71 and 78 and 80 for chamber 77 contains four holes. This selection of an arrangement of holes is desirable for the handling of magazines. Other numbers and arrangements of holes, however, may be used where the concern is with other types of items of mail. Another feature is the construction of the rollers illustrated in the various figures for driving the belts. With the feeder system of this invention it is possible to vertically stack a variety of different types of items of mail including unbound magazines and folded newspapers in plastic envelopes as well as Tyvek envelopes on the flat feed conveyor 24. It is not necessary to separate letters from flat items. Paddle 52 would be moved into contact with the last item of mail 66. The various pumps and motors would be turned on to actuate the system including the vacuum pumps. The drive for belt 24 would be initiated and the belt would thereby be driven intermittently in accordance with the contacting of the microswitch 40 by an item of mail and then the removal of that item of mail from its contact with the microswitch. The items of mail would then be conveyed seriatim away from flat horizontal belt 24 and into the sorter station for ultimate deposit in the individual bins of the transport station.

System 10 provides an effective manner for the high speed feeding of items of mail wherein there is no need for complicated gear assemblies or clutches. Moreover, most maintenance could be readily done from the top of the machine.

What is claimed is:

1. A feeder system for a mail sorter comprising a feed conveyor station for initially receiving a plurality of individual items of mail, a singulation station downstream from said feed conveyor station for removing items of mail one at a time from said feed conveyor station, and a delivery station downstream from said singulation station; said feed conveyor section including a feed conveyor belt having a horizontal upper run with a feed end and a downstream discharge end, a stack maintaining mechanism disposed over said horizontal run for maintaining the items of mail on said horizontal run in a vertical side by side stack; said singulation station including initial hold means located juxtaposed partially across said discharge end for holding a downstream-most item of mail, transfer means extending juxtaposed across a remainder of said discharge end and adjacent to said initial hold means for removing the downstream—most item of mail away from said initial hold means and conveying the downstream most item of mail to said delivery station, said initial hold means includes a first vacuum chamber having continuously exposed holes disposed toward said discharge end for drawing an item of mail in contact with said first vacuum chamber, said transfer means including a second vacuum chamber having a plurality of holes disposed toward said discharge end a vertically mounted belt mounted for movement around said second vacuum chamber; said vertically mounted belt having a plurality of holes disposed for cyclical registration. With said holes in said second vacuum chamber whereby the item of mail is drawn to said vertically mounted transport belt when said holes of said transport belt and said holes of said second vacuum chamber are aligned for removing the item of mail away from said initial hold means upon rotation of said transport belt, said transport belt being mounted at a non-perpendicular angle with respect to a longitudinal center line of said horizontal run, said transport belt being disposed inwardly of said first vacuum chamber where said transport belt is juxtaposed said first vacuum chamber, and said transport belt extending to at least the longitudinal center line of said horizontal run.

2. The system of claim 1 wherein said holes of said first vacuum chamber are in the form of a plurality of slits, said slits having an area, said holes of said second vacuum chamber comprising a first plurality of large holes having a greater area than said area of said slits, a second plurality of small holes in said second vacuum chamber, and said belt being made of a non smooth material.

3. The system of claim 2 wherein each of said vacuum chambers comprises an upper compartment and a lower compartment, a first vacuum pump having a vacuum line communicating with said upper compartments, and a second vacuum pump having a vacuum line communicating with said lower compartments.

4. A feeder system for a mail sorter comprising a feed conveyor station for initially receiving a plurality of individual items of mail, a singulation station downstream from said feed conveyor station for removing items of mail one at a time from said feed conveyor station, and a delivery station downstream from said singulation station; said feed conveyor station including a feed conveyor belt having a horizontal upper run with a feed end and a downstream discharge end, a stack maintaining mechanism disposed over said horizontal run for maintaining items of mail on said horizontal run in a vertical side by side stack; said singulation station including initial hold means located juxtaposed partially across said discharge end for holding downstream-most item of mail, transfer means extending juxtaposed across a remainder of said discharge end and adjacent to said initial hold means for removing the downstream-most item of mail away from said initial hold means and conveying the downstream-most item of mail to said delivery station, said initial hold means including a first vacuum chamber having continuously exposed holes disposed toward said discharge end for drawing an item of mail in contact with said first vacuum chamber, said transfer means including a second vacuum chamber having a plurality of holes disposed toward said discharge end, a vertically mounted belt mounted for movement around said second vacuum chamber, said vertically mounted belt having a plurality of holes disposed for cyclical registration with said holes in said second vacuum chamber whereby an item of mail is drawn to said vertically mounted transport belt when said holes of said transport belt and said holes of said second vacuum chamber are aligned for removing an item of mail away from said initial hold means upon rotation of said transport belt, a vacuum applied by said second vacuum chamber comprising means for overcoming coefficient of friction between a downstream-most item of mail and its adjacent item of mail to separate the downstream-most item of mail from its adjacent item of mail, said transport belt being disposed inwardly of said first vacuum chamber where said transport belt is juxtaposed said first vacuum chamber, and said transport belt extending to at least a longitudinal center line of said horizontal run.

5. The system of claim 4 wherein said stack maintaining mechanism includes a paddle mounted across and in contact with said horizontal run.

6. The system of claim 5 including a microswitch located at said downstream end for controlling operation of said feed conveyor belt whereby said feed conveyor belt is halted in its movement when said microswitch is contacted by an item of mail and continues its movement upon removal of the item of mail and whereby said movement of said feed conveyor is halted when said paddle contacts said microswitch.

7. The system of claim 5 wherein said horizontal run is contacted by said paddle at only a corner of said paddle, and said paddle having a greater area at its upper portion than at its lower portion.

8. The system of claim 7 including a guide rail, an offset bracket being mounted to said guide rail, said offset bracket having a pair of arms, one of said arms being slidably mounted on said guide rail and the other of said arms being secured to said paddle, and said paddle being mounted for movement selectively toward and away from said singulation station.

9. The system of claim 4 in combination with a mail sorter having a sorter station downstream from said delivery station and a transport station downstream from said sorter station.

10. The combination of claim 9 wherein said transport station includes a plurality of said drive units, each of said drive units including a set of diverters and two sets of drive unit belts, each of said sets of drive unit belts comprising an inner belt and a side belt and an acceleration belt in contact with each other, and a bin for each of said sets of drive unit belts.

11. The combination of claim 10 wherein each of said acceleration belts is mounted around four rollers including an outermost roller and three remaining rollers, said outermost roller of said four rollers being disposed at an entrance to its respective bin, and said outermost roller being upstream from one of said three remaining of said four rollers.

12. A feeder system for a mail sorter comprising a feed conveyor station for initially receiving a plurality of individual items of mail, a singulation station downstream from said feed conveyor station for removing items of mail one at a time from said feed conveyor station, and a delivery station downstream from said singulation station; said feed conveyor station including a feed conveyor belt having a horizontal upper run with a feed end and a downstream discharge end, a stack maintaining mechanism disposed over said horizontal run for maintaining the items of mail on said horizontal run in a vertical side by side stack; said singulation station including initial hold means located juxtaposed partially across said discharge end for holding a downstream-most item of mail, transfer means extending juxtaposed across a remainder of said discharge end and adjacent to said initial hold means for removing the downstream-most item of mail away from said initial hold means and conveying the downstream-most item of mail to said delivery station, said initial hold means including a first vacuum chamber having continuously exposed holes disposed toward said discharge end for drawing an item of mail in contact with said first vacuum chamber, said transfer means including a second vacuum chamber having a plurality of holes disposed toward said discharge end, a vertically mounted belt mounted for movement around said second vacuum chamber, said vertically mounted belt having a plurality of holes disposed for cyclical registration with said holes in said second vacuum chamber whereby an item of mail is drawn to said vertically mounted transport belt when said holes of said transport belt and said holes of said second vacuum chamber are aligned for removing the item of mail away from said initial hold means upon rotation of said transport belt, each of said vacuum chambers comprising an upper compartment and a lower compartment, and separate vacuum pumps for said upper and said lower compartments.

13. A feeder system for a mail sorter comprising a feed conveyor station for initially receiving a plurality of individual items of mail, a singulation station downstream from said feed conveyor station for removing items of mail one at a time from said feed conveyor station, and a delivery station downstream from said singulation station; said feed conveyor station including a feed conveyor belt having a horizontal upper run with a feed end and a downstream discharge end, a stack maintaining mechanism disposed over said horizontal run for maintaining the items of mail on said horizontal run in a vertical side by side stack; said singulation station including initial hold means located juxtaposed partially across said discharge end for holding a downstream-most item of mail, vertically disposed transfer means extending juxtaposed across a remainder of said discharge end and vertically side by side and adjacent to said initial hold means for removing the downstream-most item of mail away from said initial hold means and conveying the downstream-most item of mail to said delivery station, said stack maintaining mechanism including a paddle mounted across said horizontal run for contacting the items of mail and maintaining the items of mail upright, said paddle having a path of movement, a switch located at said downstream end for controlling the operation of said feed conveyor belt whereby said feed conveyor belt is halted in its movement when said switch senses an item of mail and continues its movement upon removal of the item of mail, said switch being located for sensing said paddle in said path of movement of said paddle, and said movement of said feed conveyor belt being halted when said paddle is sensed by said switch.

14. The system of claim 13 wherein said switch is a microswitch, and said microswitch being mounted in said path of movement of said paddle.

15. A feeder system for a mail sorter comprising a feed conveyor station for initially receiving a plurality of individual items of mail, a singulation station downstream from said feed conveyor station for removing items of mail one at a time from said feed conveyor station, and a delivery station downstream from said singulation station; said feed conveyor station including a feed conveyor belt having a horizontal upper run with a feed end and a downstream discharge end, a stack maintaining mechanism disposed over said horizontal run for maintaining the items of mail on said horizontal run in a vertical side by side stack; said singulation station including initial hold means located juxtaposed partially across said discharge end for holding a downstream-most item of mail, transfer means extending juxtaposed across a remainder of said discharge end and adjacent to said initial hold means for removing the downstream-most item of mail away from said initial hold means and conveying the downstream-most item of mail to said delivery station, said transfer means including a vertically mounted transport belt mounted for conveying the downstream-most item of mail away from said singulation station, a plurality of entrance flaps disposed at an entrance to said delivery station for preventing simultaneous transfer of plural items of mail, and said entrance flaps including an inner flap and an intermediate flap and an outer flap, said outer flap making greater surface contact with said transport belt than said intermediate flap, said intermediate flap making greater surface contact with said transport belt than said inner flap to contact an item of mail adjacent to the downstream-most item of mail to hold back the adjacent item of mail ,while the downstream-most item of mail is conveyed by said transport belt thereby preventing simultaneous transfer of plural items of mail.

16. The system of claim 15 wherein said inner flap is generally perpendicular to and slightly spaced from said transport belt, and said intermediate flap contacting said transport belt.

17. The system of claim 13 wherein said initial hold means includes a first vacuum chamber having continuously exposed holes disposed toward said discharge end for drawing an item of mail in contact with said first vacuum chamber, said transfer means including a second vacuum chamber having a plurality of holes disposed toward said discharge end a vertically mounted belt mounted for movement around said second vacuum chamber; and said vertically mounted belt having a plurality of holes disposed for cyclical registration with said holes in said second vacuum chamber whereby the item of mail is drawn to said vertically mounted transport belt when said holes of said transport belt and said holes of said second vacuum chamber are aligned for removing the item of mail away from said initial hold means upon rotation of said transport belt.

18. The system of claim 17 including entrance flaps disposed at the entrance to said delivery station for maintaining each item of mail in contact with said transport belt and for preventing simultaneous transfer of plural items of mail.

19. The system of claim 18 wherein said entrance flaps include a first flap disposed generally perpendicularly to said transport belt for making edge contact therewith, and at least one downstream flap disposed for making surface contact with said transport belt.

20. The system of claim 19 wherein said entrance flaps comprise three flaps, each of said flaps progressively making greater contact with said transport belt, and said flaps being adjustably mounted for movement toward and away from said transport belt.

21. The system of claim 18 wherein said delivery station includes a pinch belt mounted around a plurality of rollers, and a portion of said pinch belt being in contact with a portion of said transport belt.

22. The system of claim 21 wherein said transport belt is mounted on a plurality of rollers, said rollers for said transport belt and for said pinch belt being elongated and of non-uniform cross-sectional area, and guide surfaces on the rollers which are disposed in the path of travel of the item of mail.

* * * * *